US008025513B2

(12) United States Patent
Kobayashi et al.

(10) Patent No.: US 8,025,513 B2
(45) Date of Patent: Sep. 27, 2011

(54) LEVER-TYPE CONNECTOR WITH A HOUSING WITH PLURALITY OF PROJECTIONS FOR ENGAGING A RETAINING PORTION OF A LEVER

(75) Inventors: Tohru Kobayashi, Makinohara (JP); Shoji Yamamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/877,463

(22) Filed: Sep. 8, 2010

(65) Prior Publication Data

US 2011/0086529 A1 Apr. 14, 2011

(30) Foreign Application Priority Data

Oct. 9, 2009 (JP) ..... 2009-235526

(51) Int. Cl.
*H01R 13/62* (2006.01)

(52) U.S. Cl. ..... 439/157

(58) Field of Classification Search ..... None
See application file for complete search history.

(56) References Cited

U.S. PATENT DOCUMENTS 5,487,297 A * 1/1996 Ryan et al. ..... 72/450
5,616,038 A * 4/1997 Okamoto et al. ..... 439/157
5,709,560 A * 1/1998 Hio ..... 439/157
5,727,959 A * 3/1998 Yagi et al. ..... 439/157
7,361,036 B2 * 4/2008 Pittenger et al. ..... 439/157
7,416,425 B2 * 8/2008 Murakami et al. ..... 439/157
7,695,297 B2 * 4/2010 Pittenger et al. ..... 439/157

FOREIGN PATENT DOCUMENTS

JP 2008-108467 A 5/2008

* cited by examiner

*Primary Examiner* — Chandrika Prasad
(74) *Attorney, Agent, or Firm* — Sughrue Mion, PLLC

(57) ABSTRACT

A lever type connector includes a lever which includes a pair of parallel plates and a grip portion connecting parallel plates each other and is attached to a connector housing. Each of the parallel plates is formed with a reception hole into which one of shafts is inserted and a cam groove. First and second retaining projections which retain the lever by engaging with a retaining portion provided on the lever are provided at opposite ends of the opposite sides of the connector housing. The lever is retained by the first retaining projection so as to be located at a position where a rear face is exposed so that a terminal connected with a wire can be inserted through the rear face, and is retained by the second retaining projection so as to dispose the cam groove at a position where the cam groove can receive a cam pin of a mating connector.

7 Claims, 9 Drawing Sheets

LEVER-TYPE CONNECTOR WITH A HOUSING WITH PLURALITY OF PROJECTIONS FOR ENGAGING A RETAINING PORTION OF A LEVER

BACKGROUND

This invention relates to a lever-type connector in which a force for fitting connectors together is lowered.

There is known a lever-type connector in which a force for fitting connectors together is lowered (see, Patent Document 1). In this lever-type connector 500, as shown in FIG. 10, a lever 507 of a gate-shape having an operating portion 503 and a pair of arm portions 505 is pivotally attached to a connector housing 501 in straddling relation thereto, and cam pins for being engaged respectively in cam grooves of the lever 507 are provided at a mating connector housing 509. The cam pins are engaged in the cam grooves, respectively, and in this condition the lever 507 is pivotally moved, and by a cam action achieved by the cam pins engaged in the respective cam grooves, the two connector housings 501 and 509 are drawn toward each other, and are properly fitted together. A notch portion 513 for avoiding connection wires 511 is formed in the lever 507, and with this construction the pivotal movement of the lever 507 will not be prevented by the connection wires 511.

In the conventional lever-type connector 500, however, the lever 507 prevents the insertion of terminals, and therefore it was necessary to ship the lever 507 separately from the connector housing 501. As a result, it was necessary to pack the lever 507 separately from the connector housing 501, and the amount of packing materials increased, and it is feared that the increased amount of packing materials may affect the environment. In addition, the lever 507 must be attached to the connector housing 501 after the insertion of the terminals into the connector housing 501, and therefore the efficiency of the assembling operation was lowered.

[Patent Document 1] Japanese Patent Publication Number 2008-108467 A

SUMMARY

It is therefore one advantageous aspect of the present invention to provide a lever-type connector in which the insertion of terminals will not be prevented even in a state where a lever is attached to a connector housing, and the amount of packing materials to be used can be reduced, and also the efficiency of an assembling operation can be enhanced.

According to one aspect of the invention, there is provided a lever type connector, including:

a connector housing formed with a fitting opening at a front face in a fitting direction in which the connector housing is fit into a mating connector, and having a rear face from which a wire is lead out;

a pair of shafts projected on opposite sides of the connector housing and extending in a direction orthogonal to the fitting direction;

a lever attached to the connector housing and including a pair of parallel plates and a grip portion connecting the parallel plates each other, each of the parallel plates formed with a reception hole into which one of the shafts is inserted and a cam groove with which a cam pin of the mating connector is engaged;

a retaining portion provided on the lever; and a first retaining projection and a second retaining projection, provided at opposite ends of each of the opposite sides of the connector housing, and configured to retain the lever by engaging with the retaining portion, wherein the lever is configured to be retained by the first retaining projection so as to be located at a position where the rear face is exposed so that a terminal connected with the wire can be inserted through the rear face, and is configured to be retained by the second retaining projection so as to dispose the cam groove at a position where the cam groove can receive the cam pin of the mating connector.

Each of the first retaining projection and the second retaining projection may be provided at axisymmetric positions with respect to a line which includes one of the shafts and extends along the fitting direction.

The grip portion may connect ends of arm portions, each of which extends from each of the parallel plates in a radius direction with respect to the shafts. The retaining portion may be edge parts of the arm portions at a opposite side with respect to a rotation direction in which the arm portion is operated.

DETAILED DESCRIPTION OF EXEMPLIFIED EMBODIMENTS

A preferred embodiment of the present invention will now be described with reference to the drawings.

Figure 1:
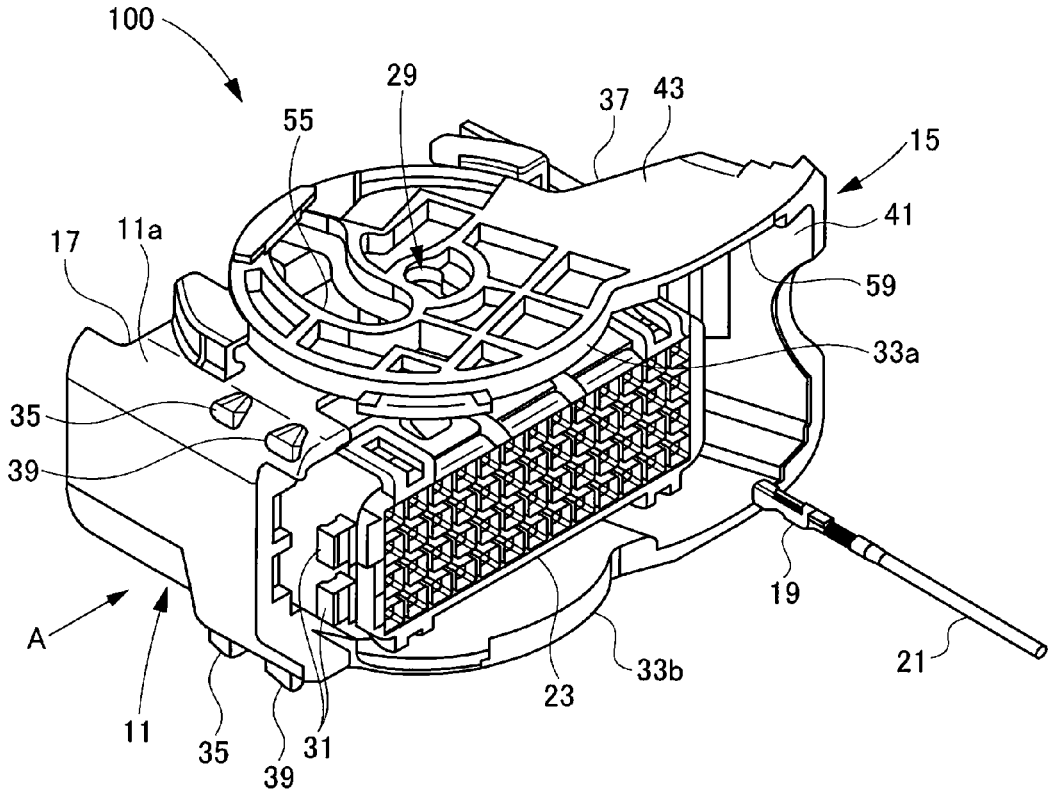
FIG. 1 is perspective view showing a lever-type connector of the present invention from which a wire cover is removed.

FIG. 1 is perspective view showing a lever-type connector of the present invention from which a wire cover is removed.

The lever-type connector 100 comprises a connector housing 11, the wire cover 13 shown in FIG. 8, and a lever 15. Each of the connector housing 11, the wire cover 13 and the lever 15 is molded into a one-piece construction, using a resin such for example as polybutylene terephthalate.

Figure 2:
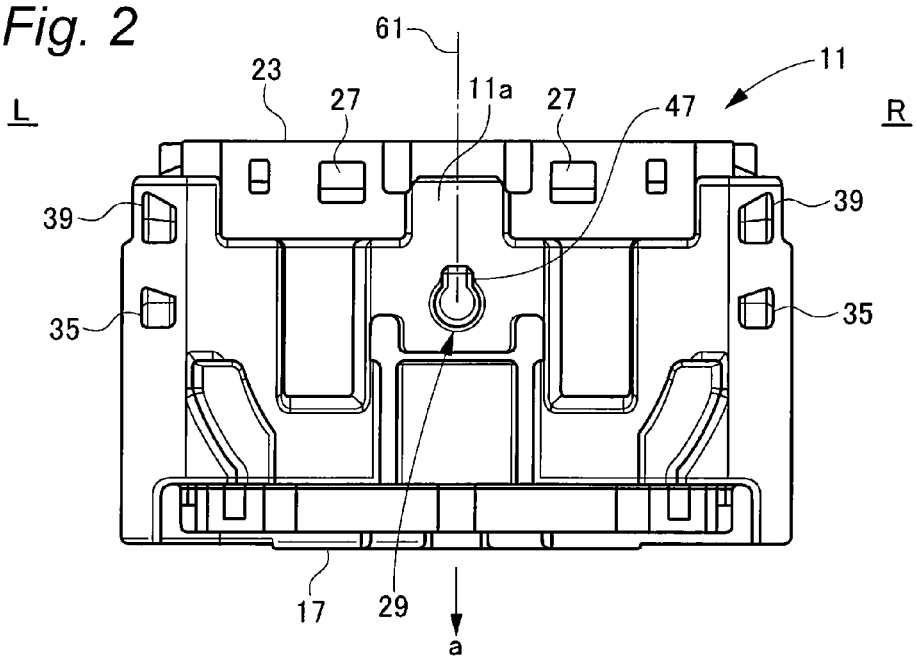
FIG. 2 is a side-elevational view of a connector housing shown in FIG. 1.
Figure 3:
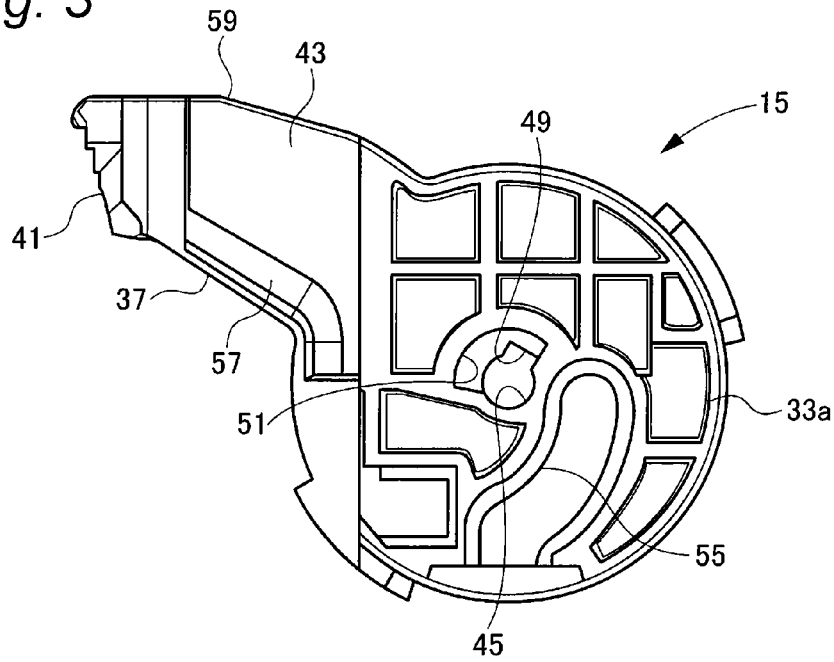
FIG. 3 is a side-elevational view of a lever shown in FIG. 1.
Figure 4:
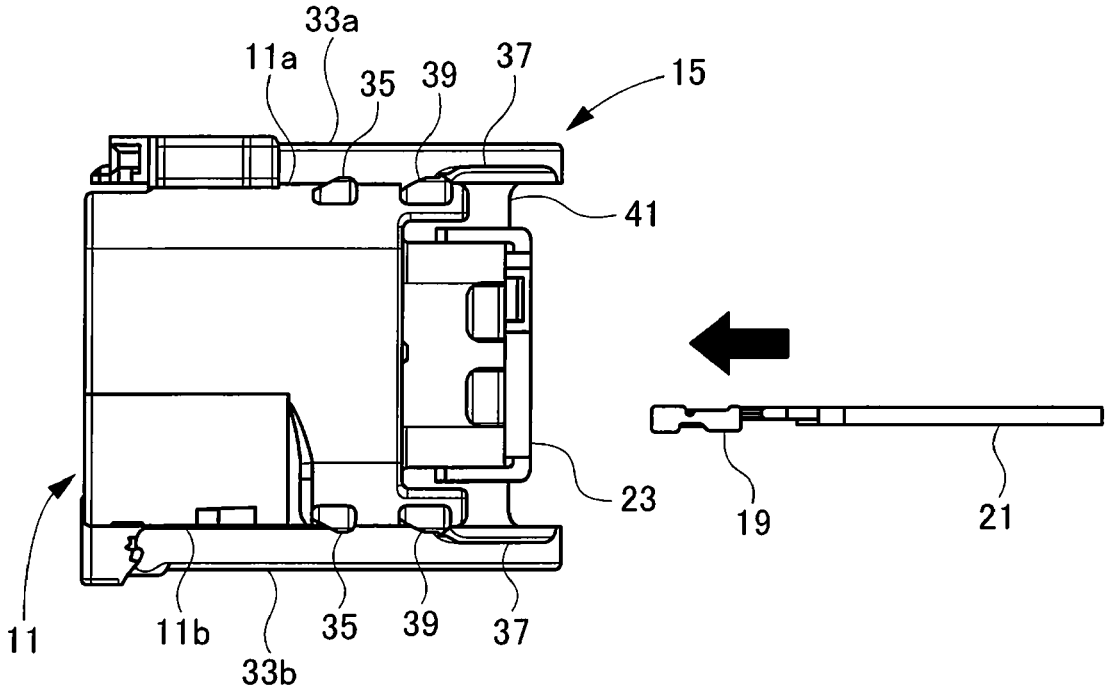
FIG. 4 is a view as seen from a direction of arrow A of FIG. 1.

FIG. 2 is a side-elevational view of the connector housing shown in FIG. 1, FIG. 3 is a side-elevational view of the lever shown in FIG. 1, and FIG. 4 is a view as seen from a direction of arrow A of FIG. 1.

In the present specification, the fitting side (the lower side in FIG. 2) of the connector housing 11 is defined as the front side, and the opposite side (the upper side in FIG. 2) is defined as the rear side. The connector housing 11 has a generally rectangular parallelepiped shape, and a fitting opening portion 17 is formed at a front side of this connector housing 11 facing in the fitting direction indicated as the arrow a in FIG. 2. In the lever-type connector 100, by pivotally moving the lever 15 serving to lower a fitting force, a mating connector 18 is drawn into the fitting opening portion 17 to be fitted thereinto. Therefore, the fitting direction a shows the direction of fitting of the connector housing 11 relative to the mating connector 18.

A plurality of terminal entry ports (not shown) are provided in the fitting opening portion 17, and are arranged in columns and rows. The terminal entry ports communicate respectively with terminal receiving chambers (not shown) formed within the connector housing 11. Metal terminals 19 are received in the terminal receiving chambers, respectively. Wires 21 are connected to rear ends of the metal terminals 19, respectively. The wires 21 are led out from a rear side 23 of the connector housing 11. According to a predetermined specification of a vehicle on which the connector is to be mounted, the wires 21 led out from the rear side 23 are bent to extend in one of two opposite directions L and R (left and right directions in FIG. 2) along a straight direction perpendicular to the fitting direction a.

As shown in FIGS. 1 and 2, two pairs of wire cover retaining portions 27 for retaining the wire cover 13 are formed on the connector housing 11, and each pair of wire cover retaining portions 27 are formed respectively on opposite side portions 11*a*, 11*b* shown in FIG. 4 of the connector housing 11. As shown in FIG. 2, the wire cover retaining portions 27 on each of the opposite side portions 11*a*, 11*b* of the connector housing 11 are arranged bilaterally symmetrically. The pair of wire cover retaining portions 27 are retained respectively on retaining projections (not shown) formed on the wire cover 13. A pair of retaining claws 31 shown in FIG. 1 are formed on and project from each of the other opposite side faces of the connector housing 11. When attaching the wire cover 13 to the connector housing 11, the pair of retaining claws 31 are retained respectively on a pair of retaining portions (not shown) of the wire cover 13. The wire cover 13 is attached to the connector housing 11 to cover the rear side 23 thereof in such a manner that the retaining projections are retained respectively on the pair of wire cover retaining portions 27 and that the pair of retaining portions are retained respectively on the retaining claws 31. The wire cover 13 can be selectively attached to the connector housing 11 in such a manner that a wire lead-out opening 25 shown in FIG. 8 for the leading-out of the wires 21 therethrough is directed in one of the two opposite directions L and R.

A pair of shafts 29 are formed respectively on the opposite side portions 11*a*, 11*b* of the connector housing 11, and project perpendicularly to the direction of arrow a. The shape of the shafts 29 will be described later together with reception holes of the lever 15.

The lever 15 includes a pair of parallel plates 33*a*, 33*b* of a generally disk-shape, and a grip portion 41 interconnecting the parallel plates 33*a*, 33*b*. That portion of the lever 15 lying between each parallel plate 33*a*, 33*b* and the grip portion 41 serves as an arm portion 43.

As shown in FIG. 3, the reception holes 45 each for the fitting of the corresponding shaft 29 of the connector housing 11 thereinto are formed respectively in the parallel plates 33*a*, 33*b* shown in FIG. 4. The lever 15 can be selectively attached to the connector housing 11 in such a manner that the lever 15 can be operated to be pivotally moved about the shafts 29 in one of two directions, that is, a clockwise direction and a counterclockwise direction as shown in FIG. 1.

As described above, the wire cover 13 can be selectively attached to the connector housing 11 in such a manner that the wire lead-out opening 25 for the leading-out of the wires 21 therethrough is directed in one of the two opposite directions L and R, and therefore the lever 15 can be selectively attached to the connector housing 11 in such a manner that the grip portion 41 is directed in one of the two opposite directions L and R. However, the wire cover 13 and the lever 15 are attached to the connector housing 11 in such a manner that the grip portion 41 of the lever 15 is not located at that side where the wire lead-out portion 25 of the wire cover 13 is disposed.

A key 47 is formed at each shaft 29 as shown in FIG. 2. A key groove 49 and a key receiving recess 51 are provided in the vicinity of the reception hole 45, as shown in FIG. 3. The key 47 is a polygonal convex portion formed at and projecting radially outwardly from a distal end of the shaft 29. The shaft 29 has a proximal end portion which has a round cross-section or may have any other suitable cross-section not projecting from a round outer diameter.

The key groove 49 is formed in an inner surface of the parallel plate 33*a*, 33*b*, and is a notch groove formed by notching an inner peripheral surface of the reception hole 45 in a radially outward direction, and the key 47 is fitted in the key groove 49. This key groove 49 extends through the parallel plate 33*a*, 33*b* from the inner surface thereof to an outer surface thereof.

The key receiving recess 51 is formed, together with the reception hole 45, in the outer surface of the parallel plate 33*a*, 33*b*. The key receiving recess 51 is the generally sector-shaped recess which allows the rotation of the parallel plate 33*a*, 33*b* relative to the key 47. The reception hole 45 and the key groove 49 are open to a bottom surface of the key receiving recess 51 of the sector-shape.

For attaching the lever 15 on the shafts 29, the pair of parallel plates 33*a*, 33*b* are elastically opened or moved away from each other, and the shafts 29 are inserted respectively into the reception holes 45 at the inner surfaces. At this time, the key 47 formed at the distal end of the shaft 29 is fitted into the key groove 49 notched in the inner peripheral surface of the reception hole 45, and by doing so, the shaft 29 can be inserted into the reception hole 45. The key 47 and the shaft 29 inserted respectively in the key groove 49 and the reception hole 45 project into the key receiving recess 51 at the outer surface side of the parallel plate 33*a*, 33*b*.

When the lever 15 in the attached condition is rotated or pivotally moved, each parallel plate 33*a*, 33*b* rotates, with the bottom surface of the key receiving recess 51 held in sliding contact with the key 47. By this rotating operation, the key groove 49 is moved away from the key 47. At this time, the keys 47 are held in sliding contact with the bottom surfaces of the key receiving recesses 51, respectively, thereby preventing the parallel plates 33*a*, 33*b* from lifting off the opposite side portions 11*a*, 11*b* of the connector housing 11, respectively.

In the lever-type connector 100, when the mating connector 18 is fitted to the fitting opening portion 17, cam pins 53 provided at the mating connector 18 are fitted respectively into cam grooves 55 of the lever 15. In accordance with the pivotal movement of the lever 15, the cam pins 53 are drawn, and the mating connector 18 is fitted to the fitting opening portion 17 of the connector housing 11.

Figure 5A:
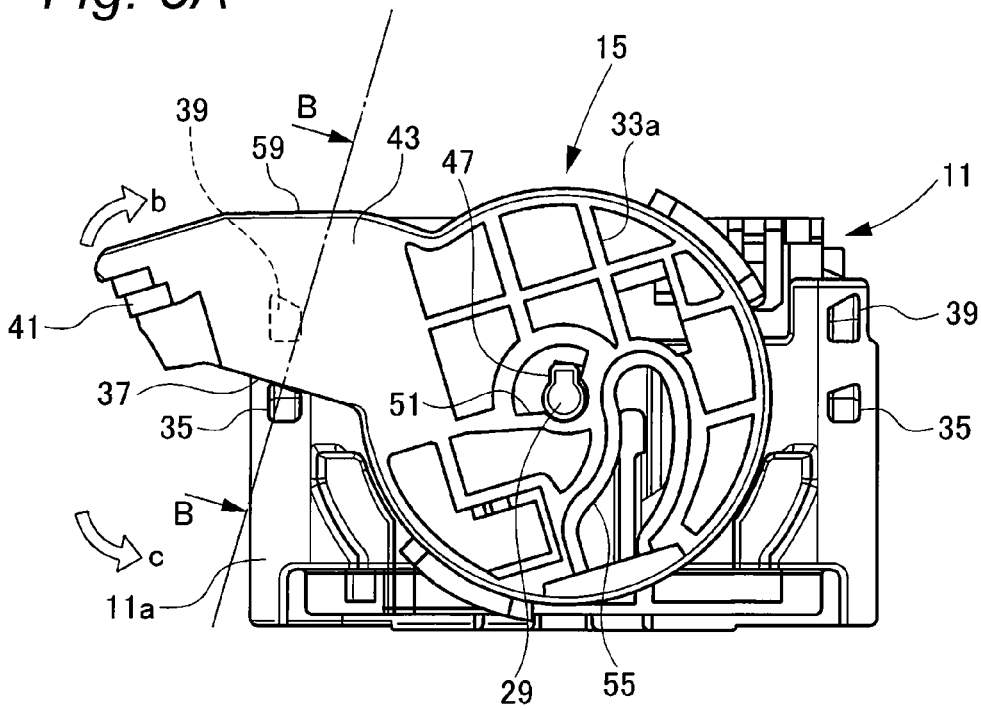
FIG. 5A is a side-elevational view showing a condition in which the lever is retained by first provisionally-retaining projections.
Figure 5B:
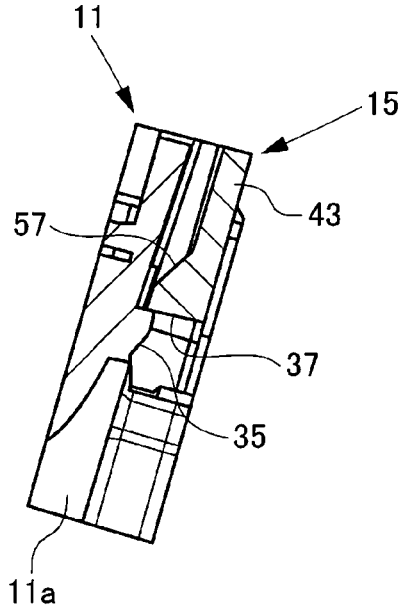
FIG. 5B is a cross-sectional view taken along the line B-B of FIG. 5A.
Figure 6A:
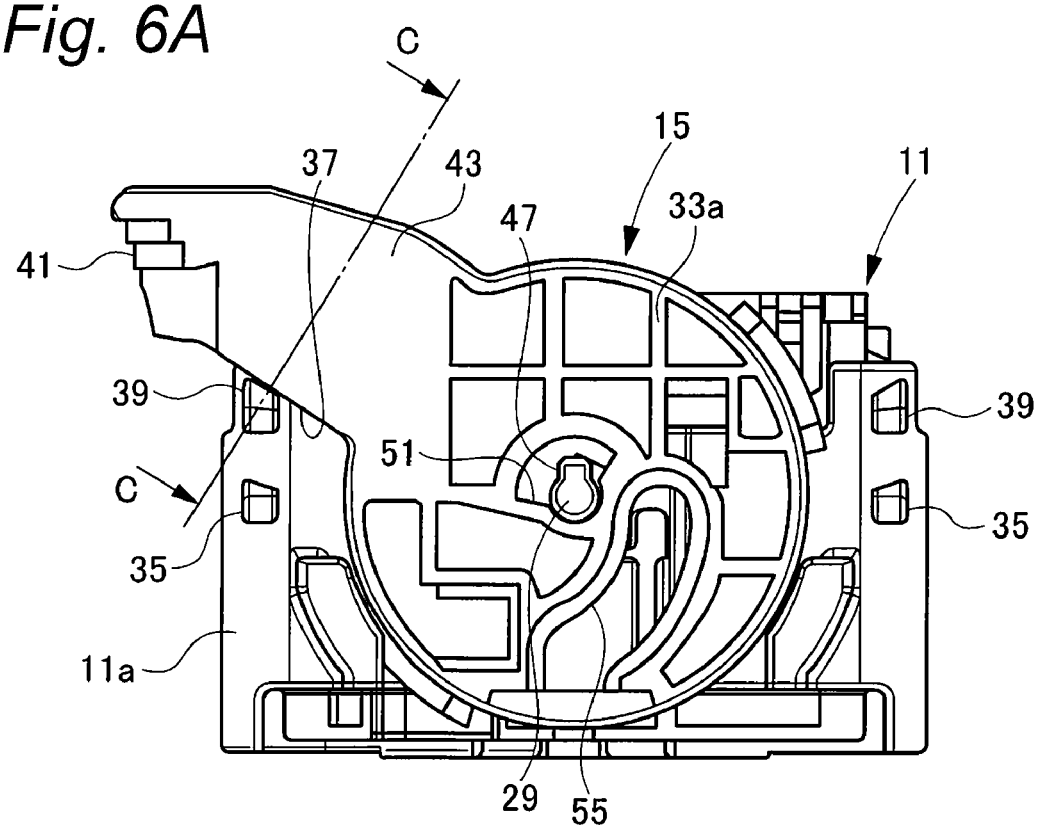
FIG. 6A is a side-elevational view showing a condition in which the lever is retained by second provisionally-retaining projections.
Figure 6B:
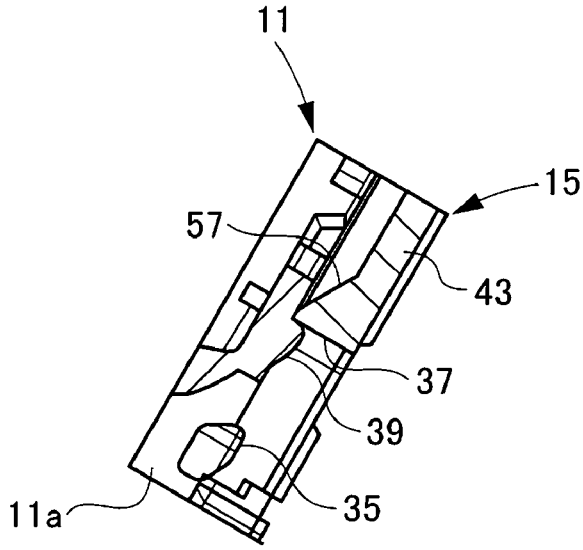
FIG. 6B is a cross-sectional view taken along the line C-C of FIG. 6A.

FIG. 5A is a side-elevational view showing a condition in which the lever is retained by first provisionally-retaining projections. FIG. 5B is a cross-sectional view taken along the line B-B of FIG. 5A. FIG. 6A is a side-elevational view showing a condition in which the lever is retained by second provisionally-retaining projections. FIG. 6B is a cross-sectional view taken along the line C-C of FIG. 6A.

Provisionally-retaining portions 37 are formed respectively at the arm portions 43 of the lever 15. Each provisionally-retaining portion 37 is a rear edge portion of the arm portion 43 facing away from a direction b of operative rotation of the arm portion 43 as shown in FIG. 5. As shown in FIG. 3, an inclined surface 57 is formed on an inner surface of the arm portion 43 and extends continuously along the direction of extending of the arm portion 43. As shown in FIG. 5B and FIG. 6B, the provisionally-retaining portion 37 is formed as a continuous wall portion of a triangular cross-section defined by the inclined surface 57 and the rear edge portion.

The first provisionally-retaining projections 35 as well as the second provisionally-retaining projections 39 which can be engaged with the provisionally-retaining portions 37 of the lever 15 to provisionally retain the lever 15 are formed respectively at left and right end portions of each of the opposite side portions 11*a* and 11*b* of the connector housing 11. When the lever 15 is retained by the first provisionally-retaining projections 35, the lever 15 opens the rear side 23, thereby enabling the wire-connected metal terminals 19 to be inserted into the connector housing 11. Also, when the lever 15 is retained by the second provisionally-retaining projections 39, the cam grooves 55 are disposed in respective positions where the cam grooves 55 can receive the respective cam pins 53 of the mating connector 18. Here, the term "open the rear side 23" means a condition in which the grip portion 41 and the arm portions 43 are retracted to respective positions where they will not interfere with the insertion of the metal terminals 19. The term "the interference with the insertion of the metal terminals 19" includes the interference with a terminal gripping jig in an automatic machine. More specifically, the lever 15 can be located in a position where a front edge portion 59 of the lever 15 facing in the operatively-rotating direction b is disposed generally parallel to the rear side 23, as shown in FIGS. 1 and 5. In other words, the lever 25 is retained by the first provisionally-retaining projection 35 so as to be located at a position where the rear side 23 is exposed so that the metal terminal 19 connected with the wire 21 can be inserted through the rear side 23.

When the provisionally-retaining portions 37 are retained respectively on the first provisionally-retaining projections 35 or the second provisionally-retaining projections 39, the lever 15 is prevented from being pivotally moved in a direction of arrow c in FIG. 5. The rotation of the lever 15 in the operatively-rotating direction b is restricted by a rotation restricting portion (not shown) while the restriction can be released. With this construction, the lever 15 is held in the position where it is retained by the first provisionally-retaining projections 35 or in the position where it is retained by the second provisionally-retaining projections 39.

When the lever 15 is retained by the first provisionally-retaining projections 35, the second provisionally-retaining projections 39 are disposed respectively at the inner sides of the arm portions 43. In this condition, when the lever 15 is pivotally moved in the direction of arrow b, each arm portion 43 is rotated to slide over the second provisionally-retaining projection 39 through the inclined surface 57.

In this embodiment, the first provisionally-retaining projections 35 as well as the second provisionally-retaining projections 39 formed on each of the opposite side portions 11*a* and 11*b* are disposed bilaterally symmetrically with respect to a straight line 61 passing through the shaft 29 along the fitting direction a. Even when the lever 15 is attached to the connector housing 11 in such a manner that the lever 15 can be operated in the clockwise direction or the counterclockwise direction, the lever 15 can be provisionally retained by the first and second provisionally-retaining projections 35 and 39 in such a manner that a posture of the lever 15 adapted to be operated in the clockwise direction and a posture of the lever 15 adapted to be operated in the counterclockwise direction are bilaterally symmetrical relative to each other. Therefore, the amount of operative rotation of the lever 15 in the clockwise direction and the amount of operative rotation of the lever 15 in the counterclockwise direction can be made equal to each other in the lever-type connector 100 in which one of the clockwise rotation and the counterclockwise rotation can be selected.

In this embodiment, further, the provisionally-retaining portion 37 is formed at each arm portion 43 of the lever 15. The rear edge portion of the arm portion 43 extending from the parallel plate 33*a*, 33*b* to be connected to the grip portion 41 is used as the provisionally-retaining portion. With this construction, projections or the like exclusively used for provisionally retaining the lever do not need to be provided at the lever 15, and therefore the structure can be simplified. Furthermore, the provisionally-retaining portions 37 are formed at the respective arm portions 43 spaced sufficiently from the axis of pivotal movement of the lever 15, and with construction a force for restricting the pivotal movement of the lever 15 can be more increased as compared with a structure in which provisionally-retaining portions are provided near to the axis of pivotal movement of the lever 15, and therefore the lever 15 can be stably held in position.

Next, the operation of the lever-type connector 100 having the above construction will be described with reference to FIG. 5 to FIG. 9.

Figure 7A:
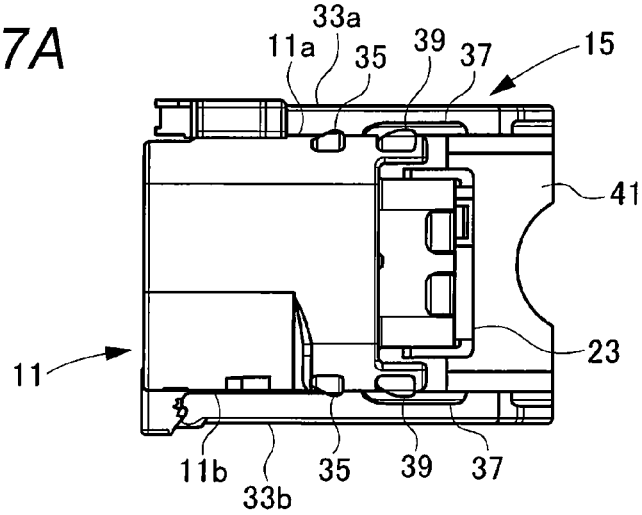
FIG. 7A is a view as seen from the direction of arrow A of FIG. 1, showing a condition in which the lever is retained by the second provisionally-retaining projections.
Figure 7B:
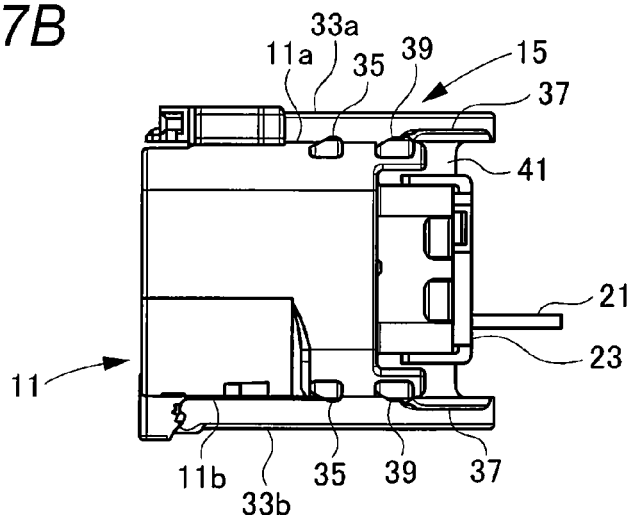
FIG. 7B is a view as seen from the direction of arrow A of FIG. 1, showing a condition in which the lever is retained by the first provisionally-retaining projections.
Figure 7C:
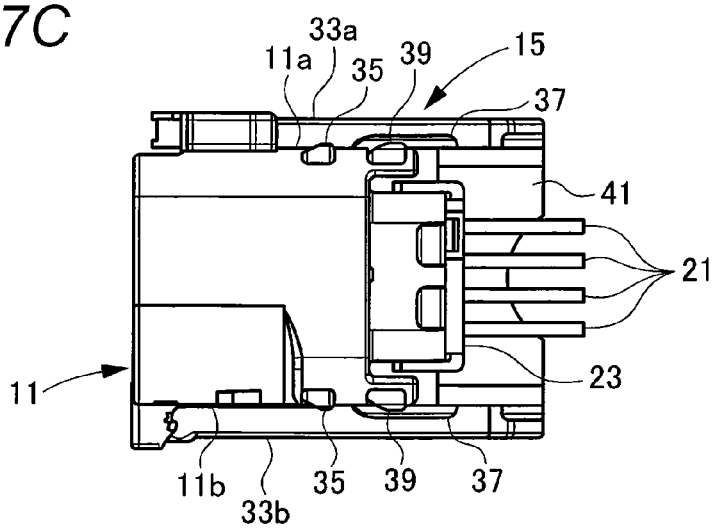
FIG. 7C is a view as seen from the direction of arrow A of FIG. 1, showing a condition in which a terminal attaching operation is completed, and the lever is retained by the second provisionally-retaining projections.

FIG. 7A is a view as seen from the direction of arrow A of FIG. 1, showing a condition in which the lever is retained by the second provisionally-retaining projections. FIG. 7B is a view as seen from the direction of arrow A of FIG. 1, showing a condition in which the lever is retained by the first provisionally-retaining projections. FIG. 7C is a view as seen from the direction of arrow A of FIG. 1, showing a condition in which a terminal attaching operation has been completed, and the lever is retained by the second provisionally-retaining projections.

The lever-type connector 100 is assembled into a condition in which the lever 15 is attached to the connector housing 11. The lever 15 is attached to the connector housing 11 in such a manner that the shafts 29 are inserted respectively into the reception holes 45, with the pair of parallel plates 33*a* and 33*b* disposed in contiguous relation respectively to the opposite side portions 11*a* and 11*b* of the connector housing 11. At this time, each shaft 29 is inserted into the reception hole 45 in such a manner that the direction of the key 47 of the shaft 29 coincides with the direction of the key groove 49.

When the lever 15 is attached to the connector housing 11, each key 47 projects into the key receiving recess 51 and is disposed therein. As a result, the lever 15 can be pivotally moved relative to the shafts 29, with the bottom surface of each key receiving recess 51 held in sliding contact with the key 47.

The lever 15 attached to the connector housing 11 is pivotally moved in the direction of arrow b in FIG. 5, and is held in the position where the provisionally-retaining portions 37 are retained respectively on the first provisionally-retaining projections 35 shown in FIG. 5. The lever-type connector 100 can be shipped in this condition. Namely, the lever-type connector 100 having the lever 15 attached thereto can be shipped in the condition in which the metal terminals 19 can be attached to the connector housing 11.

When the lever-type connector 100 having the lever 15 attached thereto is sent to an assembling line or is delivered to the user, this lever-type connector 100 is unpacked, and the metal terminals 19 connected respectively to the wires 21 are inserted into the connector housing 11. At this time, in case the lever 15 is disposed in the cam pin receiving position where the lever 15 is retained by the second provisionally-retaining projections 39, the grip portion 41 and the parallel plates 33*a*, 33*b* project from the rear side 23 as shown in FIG. 7A, and interfere with the operation for inserting the metal terminals 19. On the other hand, in the lever-type connector 100 having the first provisionally-retaining projections 35, the lever 15 is retained by the first provisionally-retaining projections 35, so that the grip portion 41 and the parallel plates 33*a*, 33*b* do not project from the rear side 23 of the connector housing 11 as shown in FIG. 7B, and the rear side 23 is kept in the open condition. As a result, the lever 15 will not interfere with the terminal inserting operation, and the metal terminals 19 can be attached to the connector housing 11.

This operation is properly effected regardless of whether the lever 15 is attached to be directed in one direction L or the other direction R, since the first provisionally-retaining projections 35 as well as the second provisionally-retaining projections 39 formed on each of the opposite side portions 11*a* and 11*b* of the connector housing 11 are disposed bilaterally symmetrically.

In the lever-type connector 100 to which all of the metal terminals 19 are attached as shown in FIG. 7C, the lever 15 is pivotally moved in the operatively rotating direction b, and is retained by the second provisionally-retaining projections 39 as shown in FIG. 6. In this condition, the lever 15 is located in the cam pin-receiving position where the cam grooves 55 can receive the respective cam pins 53.

Figure 8A:
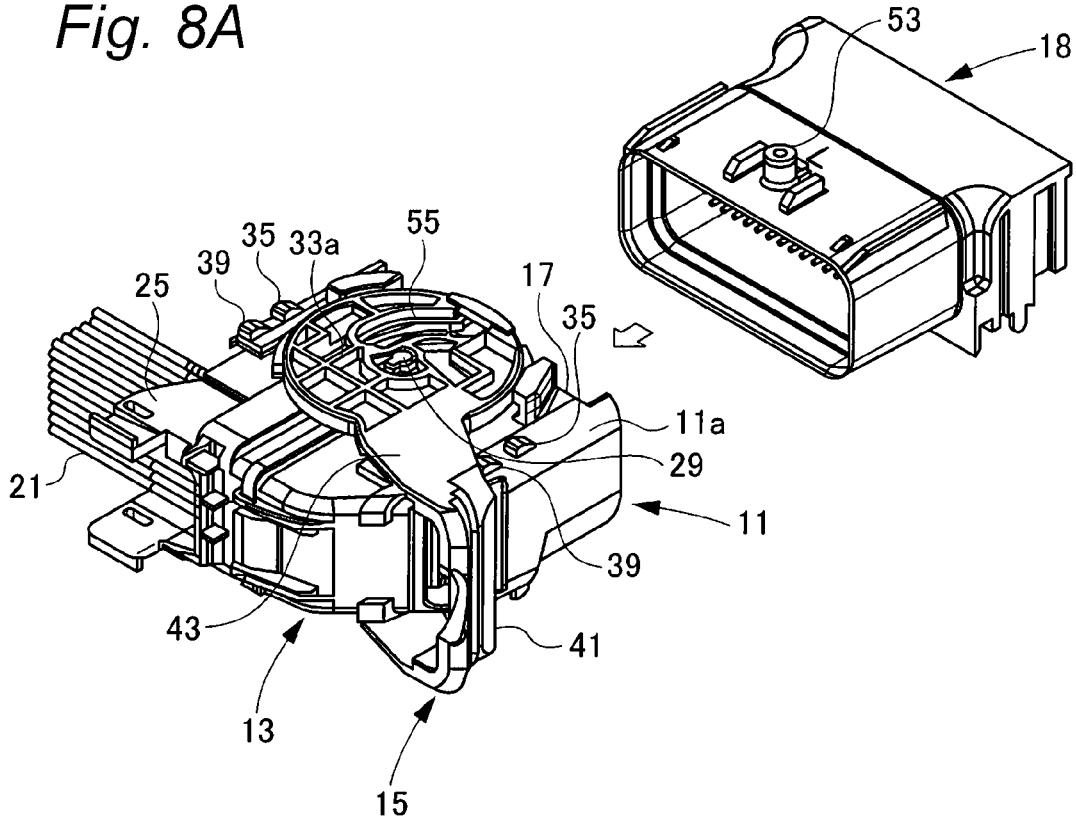
FIG. 8A is a perspective view showing a condition before the mating connector is fitted to the connector housing.
Figure 8B:
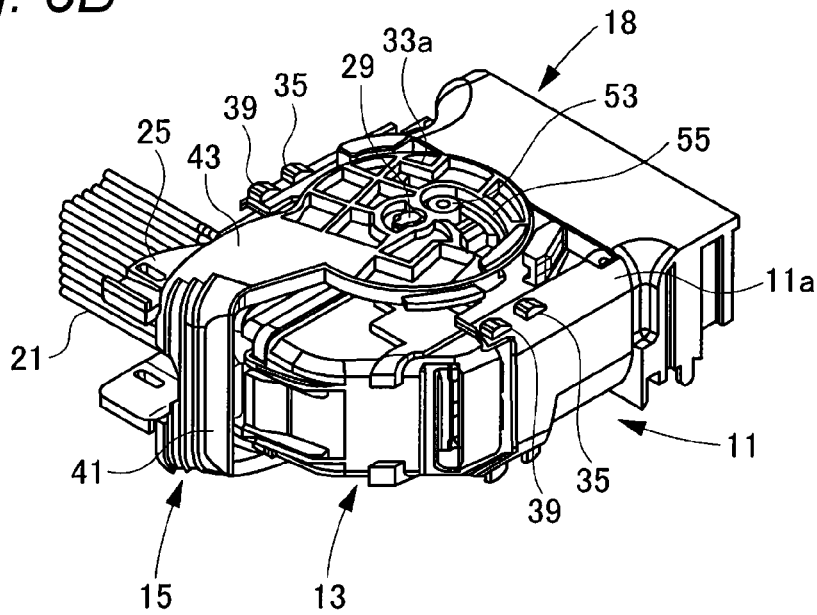
FIG. 8B is a perspective view showing a condition after the mating connector is fitted.
Figure 9A:
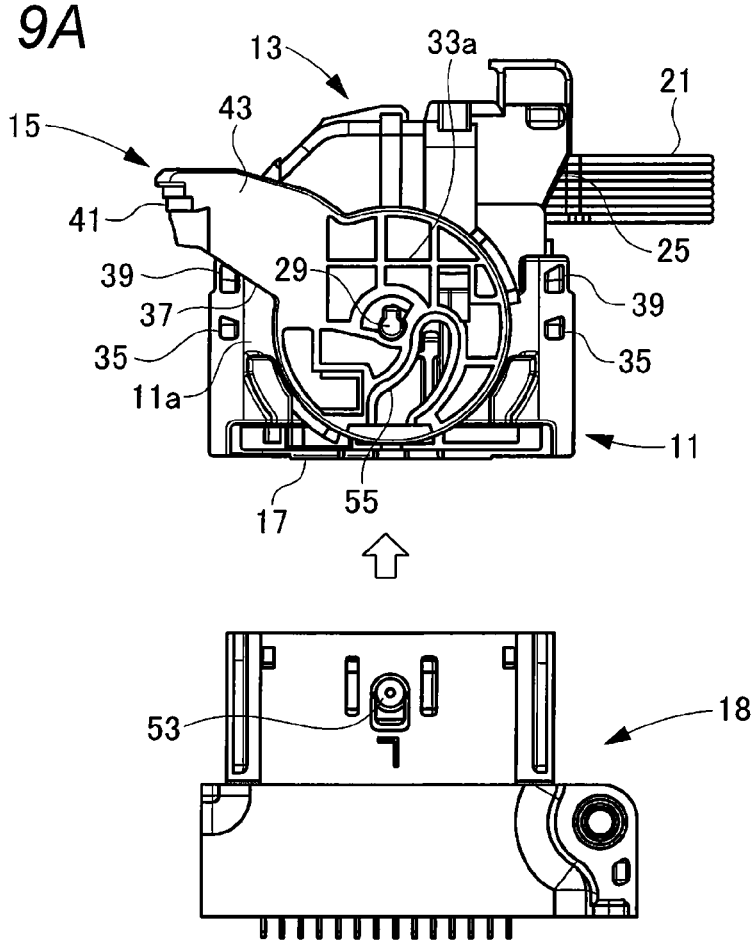
FIG. 9A is a side-elevational view showing the condition before the mating connector is fitted to the connector housing.
Figure 9B:
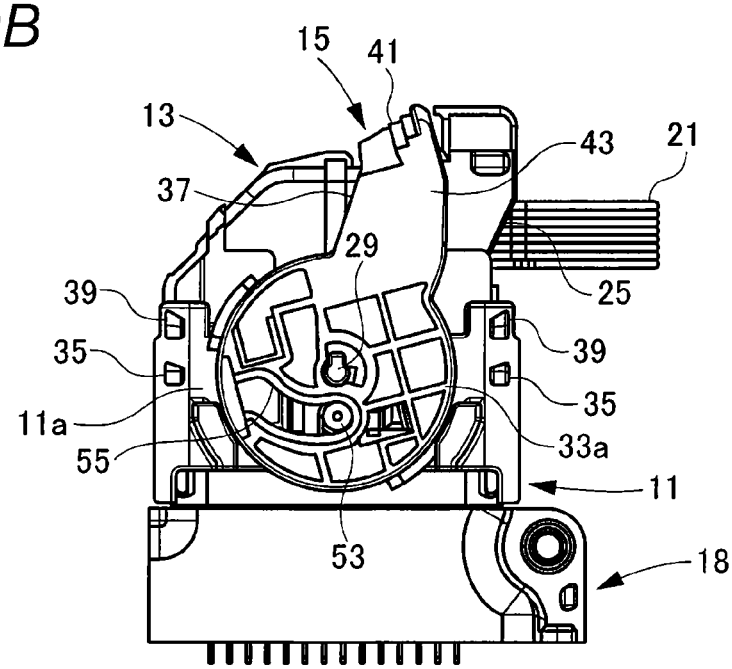
FIG. 9B is a side-elevational view showing the condition after the mating connector is fitted.
Figure 10:
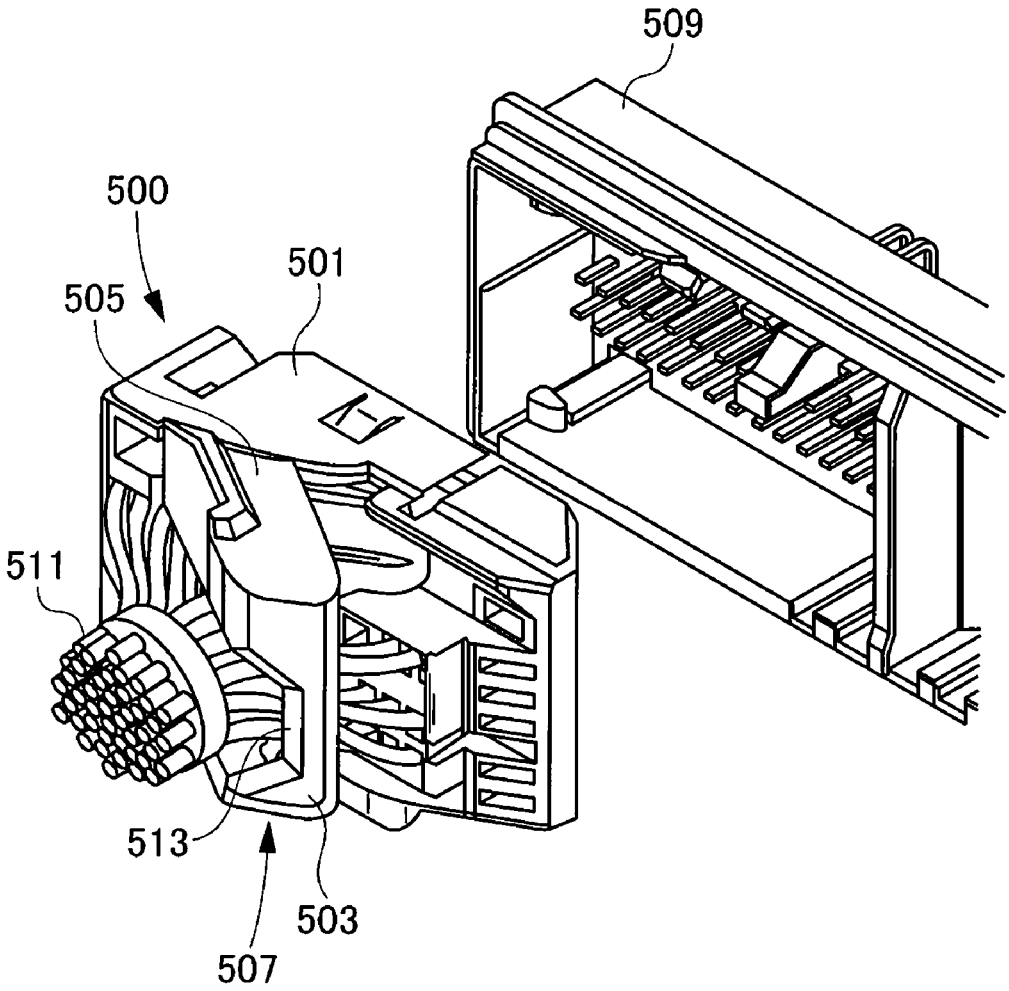
FIG. 10 is an exploded perspective view of a conventional lever-type connector.

FIG. 8A is a perspective view showing a condition before the mating connector is fitted to the connector housing, FIG. 8B is a perspective view showing a condition after the mating connector is fitted, FIG. 9A is a side-elevational view showing the condition before the mating connector is fitted, and FIG. 9B is a side-elevational view showing the condition after the mating connector is fitted.

Before the mating connector 18 is fitted to the connector housing 11, the wire cover 13 is attached to the connector housing 11. The connector housing 11 having the wire cover 13 attached thereto is located with its fitting opening portion 17 opposed to the mating connector 18 as shown in FIGS. 8A and 9A, and then the mating connector 18 is lightly fitted into the fitting opening portion 17. As a result, the cam pins 53 enter the cam grooves 55, respectively.

In this condition, when the lever 15 is pivotally moved in the operatively-rotating direction b while taking hold of the grip portion 41, the retaining engagement of the lever 15 with the second provisionally-retaining projections 39 is canceled, and the cam pins 53 move along the respective cam grooves 55. As the cam pins 53 thus move along the respective cam grooves 55, the mating connector 18 is drawn toward the connector housing 11, and resilient pieces of contact terminals received within the connector housing 11 are brought into contact respectively with contact pieces within the mating connector 18.

When the mating connector 18 and the connector housing 11 reach their respective fitting-completed positions as shown in FIGS. 18B and 19B as a result of pivotal movement of the lever 15, the lever 15 is retained or held on the connector housing 11 against movement, thus completing the fitting operation.

As described above, in the lever-type connector 100, when the lever 15 is retained by the first provisionally-retaining projections 35, the rear side 23 of the connector housing 11 is rendered open, thereby enabling the wire-connected metal terminals 19 to be inserted into the connector housing 11. Namely, a working space for inserting and withdrawing the metal terminals 19 can be secured. The operation for attaching and detaching the metal terminals 19 can be carried out without removing the lever 15 from the connector housing 11. The metal terminals 19 can be inserted into the connector housing 11 which is kept in the condition obtained at the time of shipping. Thereafter, the lever 15 is pivotally moved into the position where it is retained by the second provisionally-retaining projectons 39, and in this position, the guide grooves 55 can receive the guide pins 53, respectively.

Therefore, when the lever 15 attached to the connector housing 11 is located in the position where the lever is retained by the first provisionally-retaining projections 35, the lever 15 will not prevent the insertion of the metal terminals 19, and it is not necessary to ship the lever 15 separately from the connector housing 11.

Therefore, in the lever-type connector 100 of this embodiment, when the lever 15 is retained by the first provisionally-retaining projections 35, the lever 15 opens the rear side 23, thereby enabling the wire-connected metal terminals 19 to be inserted into the connector housing 11. Also, when the lever 15 is retained by the second provisionally-retaining projections 39, the lever 15 is located in the position where the cam grooves 55 can receive the respective cam pins 53 of the mating connector 18. Therefore, even if the lever 15 is attached to the connector housing 11, the lever 15 will not prevent the insertion of the metal terminals 19 into the connector housing 11, and the reduction of packing materials and the enhanced efficiency of the assembling operation can be achieved.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

The disclosure of Japanese Patent Application No. 2009-235526 filed Oct. 9, 2009 including specification, drawings and claims is incorporated herein by reference in it is entirety.

What is claimed is:

1. A lever type connector, comprising:

a connector housing formed with a fitting opening at a front face in a fitting direction in which the connector housing is fit into a mating connector, and having a rear face from which a wire is lead out;

a pair of shafts projected on opposite sides of the connector housing and extending in a direction orthogonal to the fitting direction;

a lever attached to the connector housing and including a pair of parallel plates and a grip portion connecting the parallel plates with each other, each of the parallel plates formed with a reception hole into which one of the shafts is inserted and a cam groove with which a cam pin of the mating connector is engaged;

a retaining portion provided on the lever; and a plurality of first retaining projections and a plurality of second retaining projections, the first retaining projections being respectively provided at one end portion and an opposite end portion of each of the opposite sides of the connector housing, the second retaining projections being respectively provided at the one end portion and the opposite end portion of each of the opposite sides of the connector housing, and wherein the housing is configured to retain the lever by engaging with the retaining portion, wherein the retaining portion of the lever is configured to be retained by at least one of the first retaining projections so that the lever is located at a first position where the rear face is exposed so that a terminal connected with the wire can be inserted through the rear face, and the retaining portion of the lever is configured to be retained by at least one of the second retaining projections so that the lever is disposed in a second position to dispose the cam groove at a position where the cam groove can receive the cam pin of the mating connector, and wherein the retaining portion selectively engages with either the at least one first retaining projection or the at least one second retaining projection.

2. The lever type connector as set forth in claim 1, wherein each of the first retaining projections and the second retaining projections are provided at axisymmetric positions with respect to a line which includes one of the shafts and extends along the fitting direction.

3. The lever type connector as set forth in claim 1, wherein the grip portion connects ends of arm portions, each of which extends from each of the parallel plates in a radial direction with respect to an axis of pivotal movement of the lever wherein the axis of pivotal movement corresponds to the axis of the shafts, and the retaining portion is edge parts of the arm portions at an opposite side with respect to a rotation direction in which the arm portion is operated.

4. The lever type connector as set forth in claim 2, wherein the grip portion connects ends of arm portions, each of which extends from the parallel plates in a radial direction with respect to an axis of pivotal movement of the lever wherein the axis of pivotal movement corresponds to the axis of the shafts, the retaining portion is edge parts of the arm portions at opposite side with respect to a rotation direction in which the arm portion is operated.

5. The lever type connector as set forth in claim 1, wherein a rotation direction in which the lever is operated can be one of a clockwise direction and a counter-clockwise direction.

6. The lever type connector as set forth in claim 1, wherein the retaining portion of the lever is selectively retained by two of the plurality of first retaining projections or by two of the plurality of second retaining projections.

7. The lever type connector as set forth in claim 6, wherein, when the lever is retained by the first retaining projections or the second retaining projections, the lever is provisionally prevented from rotating.

* * * * *